US007832331B2

(12) United States Patent
Hirotani et al.

(10) Patent No.: US 7,832,331 B2
(45) Date of Patent: Nov. 16, 2010

(54) SLIDE POSITION SENSOR AND PRESS MACHINE

(75) Inventors: Ikuhiro Hirotani, Komatsu (JP); Kiyokazu Baba, Komatsu (JP); Eiji Douba, Komatsu (JP)

(73) Assignee: Komatsu Ltd., Tokyo (JP)

( * ) Notice: Subject to any disclaimer, the term of this patent is extended or adjusted under 35 U.S.C. 154(b) by 331 days.

(21) Appl. No.: 12/136,908

(22) Filed: Jun. 11, 2008

(65) Prior Publication Data

US 2008/0307982 A1 Dec. 18, 2008

(30) Foreign Application Priority Data

Jun. 12, 2007 (JP) ..... 2007-154974

(51) Int. Cl.
*B30B 15/14* (2006.01)

(52) U.S. Cl. ..... 100/257; 100/48; 72/21.1; 72/446

(58) Field of Classification Search ..... 100/43, 100/46, 48, 257, 258 R, 258 A, 269.17, 288; 72/20.1, 21.1, 18.2, 16.4, 446; 425/451.3, 425/451.5, 589

See application file for complete search history.

(56) References Cited

U.S. PATENT DOCUMENTS

| | | | | |
|---|---|---|---|---|
| 4,890,476 | A | 1/1990 | Takahashi et al. | |
| 5,813,322 | A * | 9/1998 | Kuroda | 100/43 |
| 6,240,758 | B1 * | 6/2001 | Nagakura | 72/20.1 |
| 6,647,870 | B2 * | 11/2003 | Kohno | 100/269.14 |
| 6,655,267 | B2 * | 12/2003 | Mukai et al. | 100/258 R |
| 2003/0020194 | A1 * | 1/2003 | Di Dio et al. | 264/40.5 |

FOREIGN PATENT DOCUMENTS

| | | | |
|---|---|---|---|
| DE | 37 12 121 | A1 | 10/1987 |
| DE | 44 05 909 | A1 | 8/1995 |
| EP | 0 673 695 | B1 | 9/1995 |
| JP | 8-206896 | A | 8/1996 |
| JP | 9-314395 | A | 12/1997 |
| JP | 2004-249341 | A | 9/2004 |

OTHER PUBLICATIONS

German Office Action dated Jan. 20, 2009 (2 pages), and English translation thereof (2 pages) issued in counterpart German Application No. 102008025704.4.

* cited by examiner

*Primary Examiner*—Jimmy T Nguyen
(74) *Attorney, Agent, or Firm*—Holtz, Holtz, Goodman & Chick, PC

(57) ABSTRACT

A slide position sensor includes: a link supporting member projecting from the slide toward the upright, a dual axis link member whose first end is rotatably supported and hung by the link supporting member, a plate rotatably supported and hung by a second end of the dual axis link member, a rack that is provided to the plate and extends in the hanging direction, a pinion that meshes with the rack and an encoder system that senses the rotation of the pinion.

5 Claims, 4 Drawing Sheets

SLIDE POSITION SENSOR AND PRESS MACHINE

The priority application Number JP 2007-154974 upon which this patent application is based is hereby incorporated by reference.

BACKGROUND OF THE INVENTION

1. Field of the Invention

The present invention relates to a slide position sensor and a press machine.

2. Description of the Related Art

A press machine has conventionally been used for drawing a workpiece. The press machine of the kind is provided with a slide position sensor for sensing a position of a slide to which an upper die is attached (see, document: JP-A-09-314395, FIG. 7).

The slide position sensor disclosed in the above document includes a scale provided on a slide that is lifted up and down and a sensing device provided to a fixed upright. The sensing device senses the scale to obtain a position of the slide.

Here, the scale provided to the slide and the sensing device provided to the upright are disposed close to each other in the press machines of the kind. Besides, an eccentric load may be generated in the press machine during drawing process, which may cause an inclination of the slide.

In such a case, the disclosed slide position sensor may not tolerate the inclination of the slide, and the sensing device may be contacted with the scale or excessively spaced apart from the scale. In this case, the position of the slide is not precisely obtained. In addition, the sensing device or the scale may even be damaged because of the contact between the sensing device and the scale.

SUMMARY OF THE INVENTION

The present invention has been made regarding the above circumstances. An object of the present invention is to provide a slide position sensor and a press machine, in which: even when a slide is inclined for a reason such as an eccentric load or the like, the inclination of the slide is tolerated so that the slide position is obtained with high accuracy, and the inclination does not cause damage on the sensor.

The following slide position sensor and the press machine are provided by the present invention to solve the above problems.

A slide position sensor according to an aspect of the present invention is a slide position sensor for sensing a relative position of a slide relative to one of a plurality of uprights, the slide being supported by a crown and lifted up and down, the crown being supported by the plurality of uprights. The slide position sensor according to the aspect of the present invention includes: a link supporting member projecting from the slide toward the one of the plurality of the uprights; a dual axis link member whose first end is rotatably supported and hung by the link supporting member; a plate rotatably supported and hung by a second end of the dual axis link member; a rack that is provided to the plate and extends in a hanging direction; a pinion that meshes with the rack; and an encoder that is fixed to the one of the plurality of uprights and senses a rotation of the pinion.

According to the aspect of the invention, a link supporting member projecting from the slide toward one of the plurality of the uprights, a dual axis link member whose first end is rotatably supported and hung by the link supporting member, a plate rotatably supported and hung by a second end of the dual axis link member, a rack that is provided to the plate and extends in a hanging direction, a pinion that meshes with the rack, and an encoder that is fixed to the one of the plurality of uprights and senses rotation of the pinion are provided. Accordingly, even when the slide is inclined for a reason such as an eccentric load or the like, the dual axis link member is rotated to be inclined relative to the link supporting member, and the plate is also rotated to be inclined relative to the link supporting member. Consequently, the hanging direction of the plate can be kept vertical by the weight of the plate.

Therefore, the rack provided to the plate and the pinion connected to the encoder provided to the upright can properly keep a meshed state, so that a position of the slide can be properly sensed by the encoder. In other words, a position of the slide can be sensed with high accuracy while tolerating inclination of the slide. In addition, since the plate having the rack is kept vertical, the upright is prevented from being contacted. Therefore, damage to the sensor can be prevented.

In the above arrangement, it is preferable that a first allowance clearance be provided between the dual axis link member and the link supporting member, and a second allowance clearance be provided between the dual axis link member and the plate.

Here, the "allowance clearance" is a clearance in an axial direction that is larger than a conventional clearance, and thus is a clearance different from a conventional clearance.

With the above arrangement, the allowance clearance is provided between the dual axis link member and the link supporting member, and the allowance clearance is also provided between the dual axis link member and the plate. Accordingly, even when the slide is inclined in a direction intersecting the rotating direction of the dual axis link member, the inclination is tolerated by the allowance clearances. Therefore, a position of the slide is properly sensed by the encoder.

In the above arrangements, it is preferable that a guide roller mechanism be fixed to the one of the plurality of uprights and a vertical movement of the rack be guided in an extending direction of the one of the plurality of the uprights by the guide roller mechanism.

With the above arrangement, since the upright is provided with the guide roller mechanism which guides the vertical movement of the rack in the extending direction of the upright, the vertical movement of the rack can be guided in the extending direction of the upright by the guide roller mechanism. Accordingly, the rack can be properly meshed with the pinion coupled with the encoder provided to the upright. Therefore, a position of the slide can be properly sensed by the encoder.

A press machine according to an aspect of the present invention is a press machine that draws a workpiece by an upper die and a lower die. The slide position sensor includes the slide position sensor according to the aspect of the present invention.

In the above arrangement, it is preferable that each of the plurality of the uprights be equipped with the slide position sensor.

According to the aspect of the invention, since each of the plurality of the uprights is equipped with the slide position sensor, inclination of the slide is properly sensed by the slide position sensor. Therefore, the downward movement of the slide relative to the workpiece can be properly controlled.

DETAILED DESCRIPTION OF PREFERRED EMBODIMENTS

Embodiments of a slide position sensor and a press machine according to the present invention will be described below with reference to the drawings.

Figure 1:
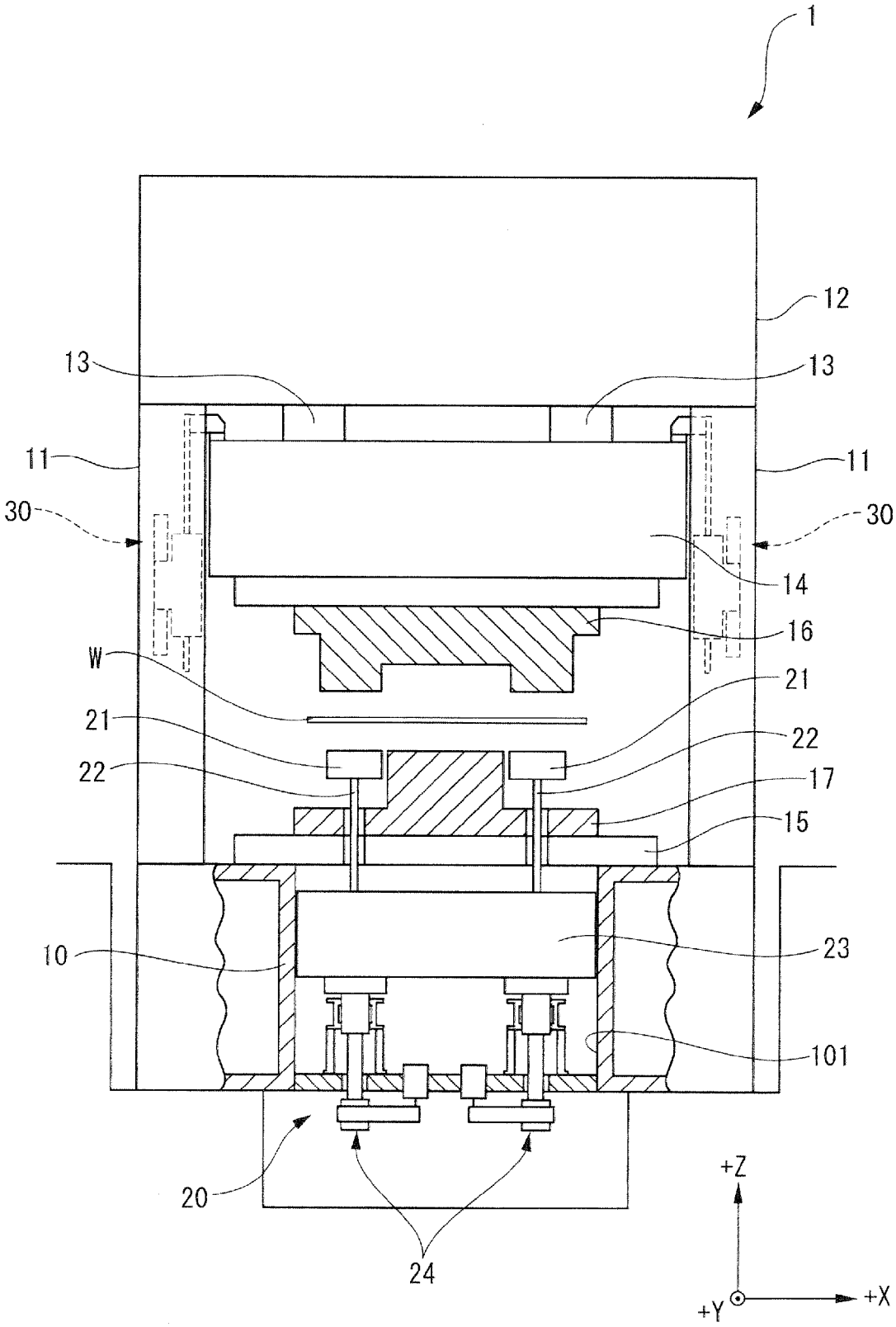
FIG. 1 is a schematic illustration showing an embodiment of a press machine according to the present invention.

FIG. 1 is a schematic illustration showing an embodiment of the press machine 1 according to the present invention.

A workpiece W is drawn by an upper die 16 and a lower die 17 of the press machine 1. As shown in FIG. 1, the press machine 1 includes: a bed 10; an upright 11 extending upward from the bed 10; a crown 12 supported by the upright 11, a slide 14 connected to the crown 12 via four plungers 13 (two of which are shown in the figures); and a moving bolster 15 disposed on top of the bed 10. Incidentally, the upper die 16 is attached to a lower surface of the slide 14, and the lower die 17 is attached to an upper surface of the moving bolster 15. In addition, a die-cushion device 20 is provided to an inner space 101 of the bed 10 of the press machine 1.

As shown in FIG. 1, the bed 10 is substantially box-shaped and disposed in a pit dug under a floor.

The crown 12 houses a driving force transfer mechanism such as a crank mechanism, an eccentric mechanism, a link mechanism or the like for lifting up and down the plunger 13. Vertical movement of the slide 14 is effected by the plungers 13 so that the upper die 16 moves toward and apart from the workpiece W.

The moving bolster 15 includes a platen bolster (not specifically shown) and a carrier (not specifically shown) disposed on top of the bed 10 to support the bolster.

The lower die 17 is attached to the bolster. A number of insertion holes through which cushion pins 22 (portion of the die-cushion device 20) are insertable penetrate the bolster from an upper surface thereof to a lower surface thereof. The carrier includes: a transfer means that transfers the bolster to the exterior of the press machine 1 for exchange of the dies 16 and 17; and ribs suitably provided to support the bolster.

The die-cushion device 20 substantially includes: a blank holder 21 which holds the workpiece W between the blank holder 21 and the upper die 16; a die-cushion pad 23 which holds the blank holder 21 via the cushion pins 22; and a lifter 24 which lifts up and down the die-cushion pad 23.

The blank holder 21 includes an upper surface on top of which the workpiece W is disposed and a lower surface to which supporting force from the cushion pin 22 is applied. The cushion pin 22 extends upward from the die-cushion pad 23. A lower side of the cushion pin 22 abuts to the die-cushion pad 23, and an upper side of the cushion pin 22 abuts to the lower surface of the blank holder 21 to support the blank holder 21.

The die-cushion pad 23 is formed as a metallic hollow rectangular box and substantially accommodated in the inner space 101 of the bed 10.

The lifter 24 lifts up and down the die-cushion pad 23. While the workpiece W is drawn, the lifter 24 lifts up and down the die-cushion pad 23 in a manner resiliently supporting the die-cushion pad 23.

The lifter 24, though not specifically shown, includes: a cylinder abutting a lower surface of the die-cushion pad 23; a piston which is disposed in the cylinder to form a hydraulic chamber in the cylinder while supporting the cylinder; and a ball screw which lifts up and down the piston. The ball screw is lifted up and down by a driving force generator such as a servo motor or the like via a driving farce transfer mechanism having a pulley and a timing belt. Incidentally, the lifter 24 is electrically connected to an external controller that controls the entire press machine 1 to be controlled by the external controller. Besides, the lifter 24 senses hydraulic pressure in the hydraulic chamber and transmits the obtained sensing signals to the external controller.

Four slide position sensors 30, which sense a relative position of the slide 14 relative to the uprights 11 while the slide 14 hung from the crown 12 is lifted up and down, are provided to the press machine 1. One slide position sensor 30 is provided for each of the four uprights 11.

Figure 2:
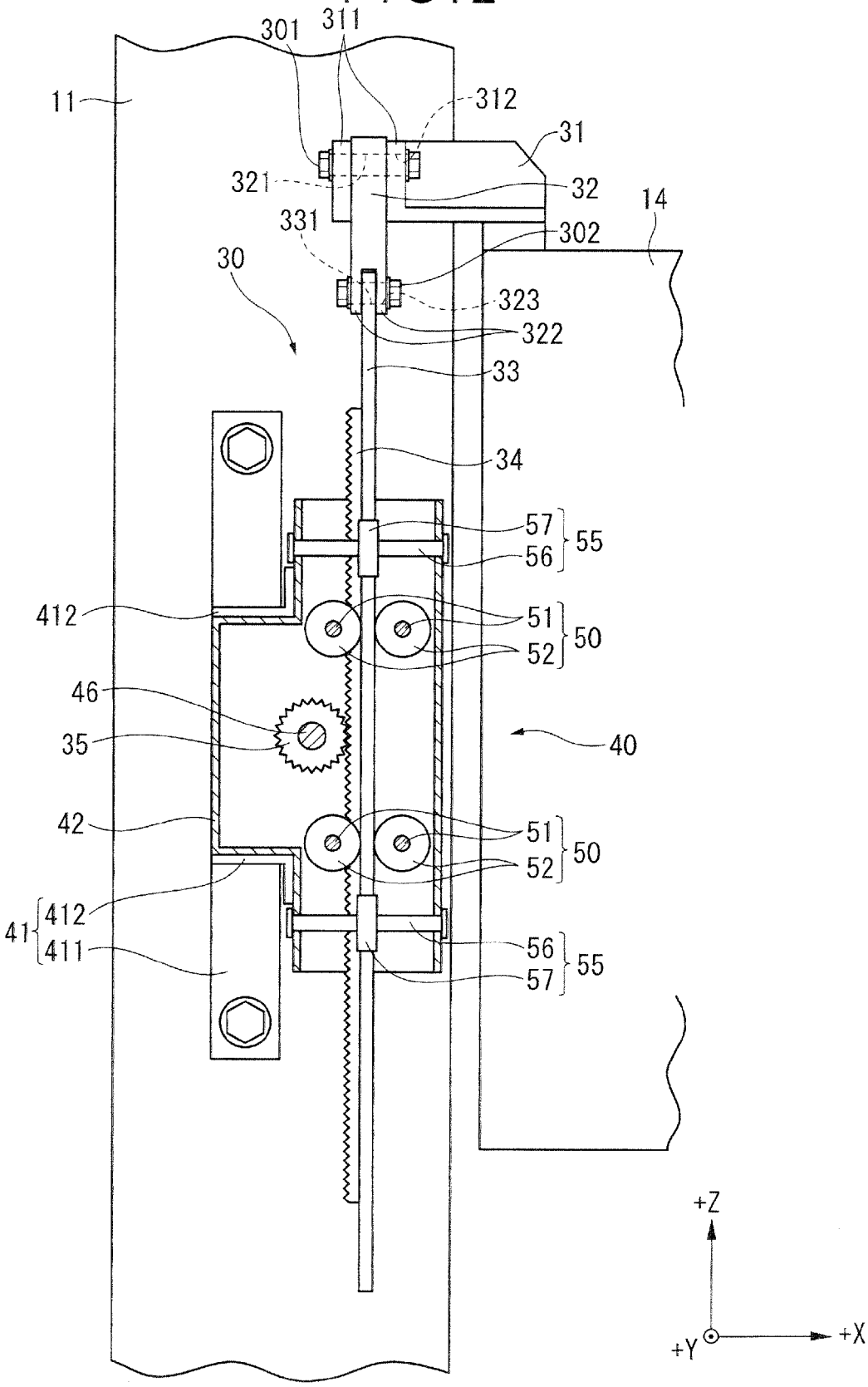
FIG. 2 is a schematic illustration of an embodiment of a slide position sensor.
Figure 3:
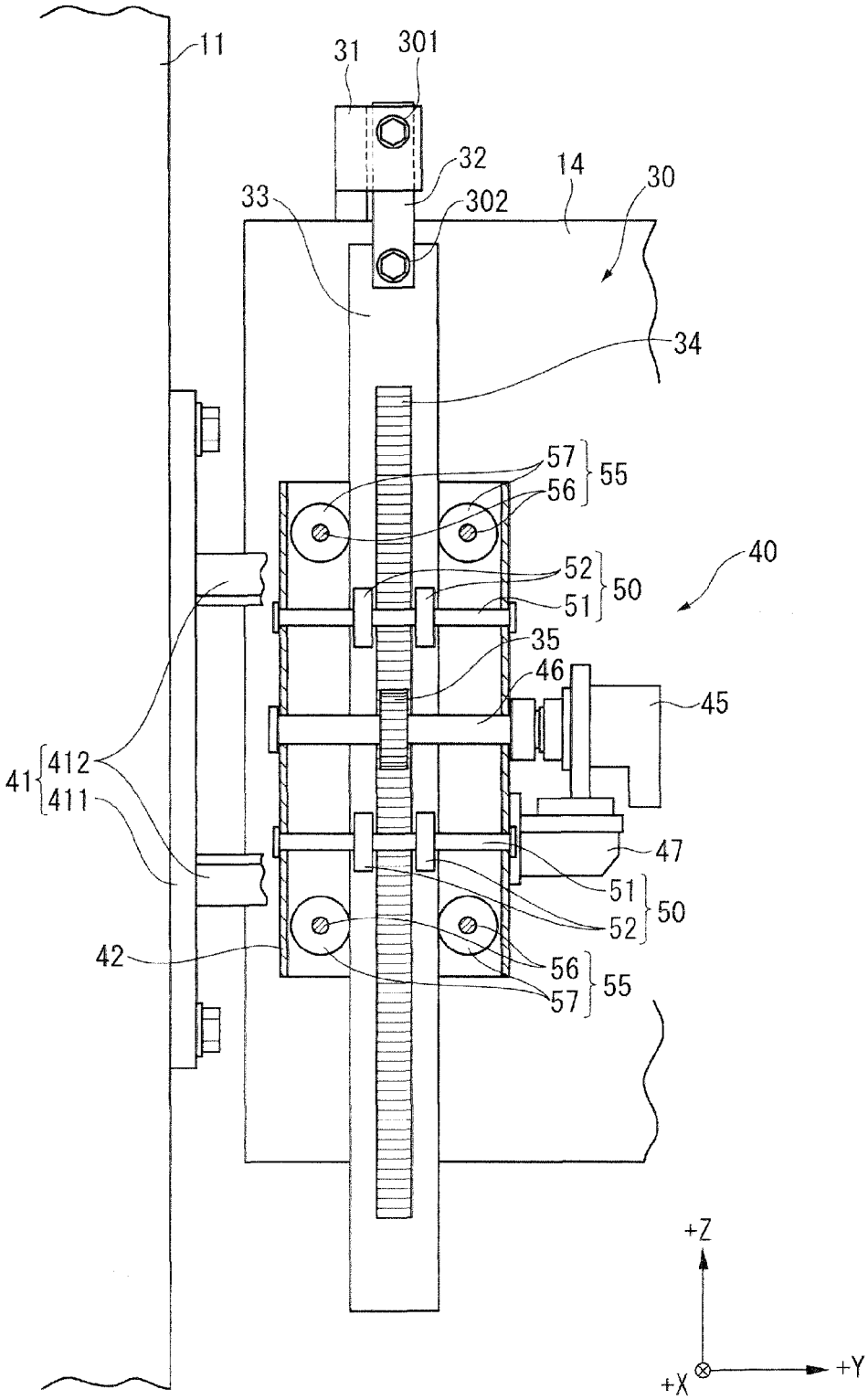
FIG. 3 is a schematic illustration of the slide position sensor viewed in a direction perpendicular to the viewing direction of FIG. 2.

FIG. 2 is a cross sectional view showing an internal structure of the slide position sensor 30. FIG. 3 is a cross sectional view showing the internal structure of the slide position sensor 30 in a cross sectional direction perpendicular to the cross sectional direction of FIG. 2. Note that only two of the slide position sensors 30 are illustrated in dot lines in FIG. 1. The slide position sensors 30 are disposed between the uprights 11 and on opposing sides of the press machine 1.

As shown in FIGS. 2 and 3, the slide position sensor 30 includes: a link supporting member 31 projecting from the slide 14 toward the upright 11; a dual axis link member 32 whose first end is rotatably supported and hung by the link supporting member 31; a plate 33 rotatably supported and hung by a second end of the dual axis link member 32; a rack 34 that is provided to the plate 33 and extends in the hanging direction; a pinion 35 that meshes with the rack 34; and an encoder system 40 that senses rotation of the pinion 35.

As shown in FIG. 2, the link supporting member 31 is provided to the slide 14 in a substantially L-shaped manner projecting from a region near the upright 11 of the upper surface of the slide 14 toward the upright 11. Two first projecting plates 311 spaced apart from each other with a predetermined distance inbetween project from a side near the upright 11 of the link supporting member 31 in parallel to the YZ plane in the figure. A supporting hole 312 is provided penetrating the two first projecting plates 311 to bear the first supporting member 301. The first supporting member 301 is inserted through the supporting hole 312 and a supporting-member-side supporting hole 321 provided to the first side of the dual axis link member 32, so that the dual axis link member 32 is rotatably supported.

The dual axis link member 32 has a substantially rectangular shape. The supporting-member-side supporting hole 321 through which the first supporting member 301 is inserted is provided to the first end (upper end) of the dual axis link member 32. Two second projecting plates 322 spaced apart from each other with a predetermined distance inbetween project from the second end (lower end) of the dual axis link member 32 in parallel to the YZ plane in the figure. A rack-side supporting hole 323 is provided penetrating the two second projecting plates 322 to bear the second supporting member 302.

The first supporting member 301 is inserted through the support-member-side supporting hole 321 of the dual axis link member 32 and the supporting hole 312 of the link supporting member 31, so that the dual axis link member 32 is rotatably supported and hung by the link supporting member 31. The second supporting member 302 is inserted through the rack-side supporting hole 323 and a supporting hole 331 provided to a first end of the plate 33, so that the plate 33 is rotatably supported.

The plate 33 is formed as a thin and substantially rectangular plate 33 for flexibility. The supporting hole 331 through which the second supporting member 302 is inserted is provided to the first end (upper end) of the plate 33.

The second supporting member 302 is inserted through the supporting hole 331 of the plate 33 and the rack-side supporting hole 323 of the dual axis link member 32, so that the dual axis link member 32 is rotatably supported and hung by the dual axis link member 32. In addition, the rack 34 extending in a longitudinal direction of the plate 33 is provided to the plate 33 along the hanging direction of the plate 33. The rack 34 meshes with the pinion 35.

An allowance clearance is provided between the dual axis link member 32 and the link supporting member 31. An allowance clearance is also provided between the dual axis link member 32 and the plate 33.

Figure 4:
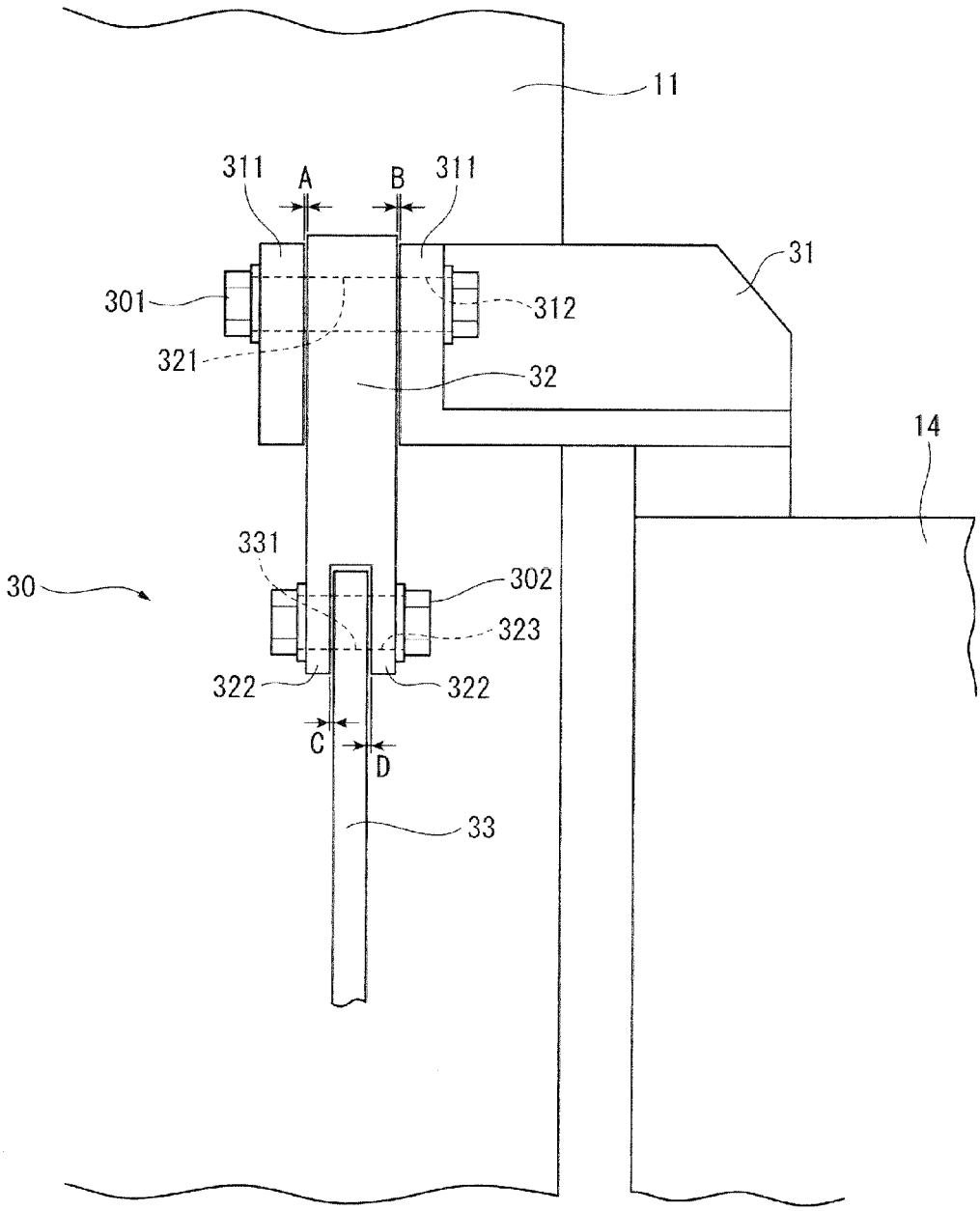
FIG. 4 is an enlarged view of a dual axis link member.

FIG. 4 is an enlarged view of the dual axis link member 32.

As shown in FIG. 4, the clearance between the dual axis link member 32 and the first projecting plate 311 of the link supporting member 31 is determined to be larger than a corresponding conventional clearance. More specifically, first allowance clearances A and B provided between the dual axis link member 32 and each of the first projecting plates 311 are respectively 1 mm in the axial direction of the first supporting member 301, which is larger than a conventional clearance of 0.1 mm.

The clearance between the plate 33 and the second projecting plate 322 of the dual axis link member 32 is also determined to be larger than a corresponding conventional clearance. More specifically, second allowance clearances C and D provided between the dual axis link member 32 and each of the second projecting plates 322 are respectively 1.5 mm in the axial direction of the second supporting member 302, which is larger than a conventional clearance of 0.1 mm.

Next, the encoder system 40 fixed to the upright 11 for sensing the rotation of the pinion 35 will be described.

The encoder system 40 includes: a bracket 41 fixed to the upright 11; a rack inserting box 42 supported by the bracket 41; and an encoder 45 fixed to the rack inserting box 42.

The bracket 41 includes a bracket body 411 and a projection 412 and fixes the rack inserting box 42 to the upright 11.

The rack inserting box 42 fixed to the upright 11 via the bracket 41 is shaped having openings on the top and bottom sides and walls on the four lateral sides. Here, a side fixed to the upright 11 has a partially different shape. The plate 33 having the rack 34 is provided inside the rack inserting box 42 in a relatively movable manner. Incidentally, ends of the rack inserting box 42 are communicated in a direction parallel to the extending direction of the upright 11.

A relative movement (vertical movement) of the plate 33 having the rack 34 is guided in the extending direction of the upright 11 by a first guide roller mechanism 50 and a second guide roller mechanism 55 provided inside the rack inserting box 42. A first set of the first guide roller mechanism 50 and the second guide roller mechanism 55 is provided to an upper side of the meshing section of the rack 34 and the pinion 35, and a second set of the same is provided to a lower side of the meshing section of the rack 34 and the pinion 35.

As shown in FIGS. 2 and 3, the first guide roller mechanism 50 restrains a movement of the plate 33 in the ±X-axis direction and guides the vertical movement of the rack 34 (in the ±Z-axis direction). In other words, the first guide roller mechanism 50 includes: two guide shafts 51 which align in the X-axis direction with the plate 33 inbetween and extend in the Y-axis direction; and two guide rollers 52 which are supported by the guide shafts 51 and rotated while abutting YZ plane surfaces of the plate 33.

The two guide shafts 51 are respectively provided side by side with the plate 33 when viewed in the Y-axis direction and rotatably supported to the lateral walls facing across the interior of the rack inserting box 42. Each of the guide shafts 51 is provided with two of the guide rollers 52 that are disposed adjacent to two opposing sides of the rack 34. Accordingly, the guide rollers 52, as shown in FIGS. 2 and 3, abut to the YZ plane surfaces of the plate 33 with the plate 33 inbetween and rotate by the vertical movement of the plate 33 to restrain the movement of the plate 33 in the ±X-axis direction.

As shown in FIGS. 2 and 3, the second guide roller mechanism 55 restrains a movement of the plate 33 in the ±Y-axis direction and guides a vertical movement of the rack 34 (in the ±Z-axis direction).

In other words, the second guide roller mechanism 55 includes: two guide shafts 56 which align in the Y-axis direction with the plate 33 inbetween and extend in the X-axis direction; and guide rollers 57 which are supported by the guide shafts 56 and rotated while abutting XZ plane surfaces of the plate 33.

The two guide shafts 56 are respectively provided side by side with the plate 33 when viewed in the X-axis direction and disposed across the interior of the rack inserting box 42 to be rotatably supported to the opposing lateral walls of the rack inserting box 42. Each of the guide shafts 56 is provided with one of the guide rollers 57, and the guide rollers 57 are provided with the rack 34 inbetween. Accordingly, as shown in FIGS. 2 and 3, the guide rollers 57 abut to the XZ plane surfaces of the plate 33 with the plate 33 inbetween and rotate by the vertical movement of the plate 33 to restrain the movement of the plate 33 in the ±Y-axis direction.

The above-mentioned pinion 35 meshing with the rack 34 is supported by a rotation shaft 46. The rotation shaft 46 is rotatably supported by the lateral walls of the rack inserting box 42, and an end of the rotation shaft 46 is connected to the encoder 45. An anti-backlash gear which has as little backlash as possible and meshes with the rack with high accuracy is used for the pinion 35 meshing with the rack 34.

An encoder mount 47 extends externally in the +Y-axis direction from a lateral wall in the +Y-axis direction of the rack inserting box 42. The encoder 45 is mounted on the encoder mount 47.

The encoder 45 is connected to the end of the rotation shaft 46 to sense the rotation of the pinion 35 meshing with the rack 34. The encoder 45 also is electrically connected to the external controller to transmit the obtained sensing signals to the external controller.

The following functions and effects are provided by the slide position sensor 30 and the press machine 1 with the above arrangement.

In the above slide position sensor 30 and the press machine 1, even when the slide 14 is inclined for a reason such as an eccentric load or the like, the dual axis link member 32 is rotated to be inclined relative to the link supporting member 31, and the plate 33 is also rotated to be inclined relative to the link supporting member 31. Accordingly, the hanging direction of the plate 33 can be kept vertical by the weight thereof.

Therefore, the rack 34 provided to the plate 33 and the pinion 35 connected to the encoder 45 provided to the upright 11 can properly keep a meshed state, so that the position of the slide 14 can be properly sensed by the encoder 45. In other words, the position of the slide 14 can be sensed with high accuracy while inclination of the slide 14 is tolerated. Since the plate 33 having the rack 34 is kept vertical, the upright 11 is prevented from being contacted. Therefore, damage to the sensor can be prevented.

In addition, the first allowance clearances A and B each having a width of 1 mm in the axial direction of the first supporting member 301 are provided between the dual axis link member 32 and the link supporting member 31; and the second allowance clearances C and D each having a width of 1.5 mm in the axial direction of the second supporting member 302 are also provided between the dual axis link member 32 and the plate 33. Accordingly, even when the slide 14 is inclined in a direction intersecting the rotating direction (swinging direction) of the dual axis link member 32, the plate 33 flexes while the inclination is tolerated by the allowance clearances A, B, C, and D. Therefore, a position of the slide 14 is properly sensed by the encoder 45.

In addition, since the upright 11 is provided with the guide roller mechanism which guides the vertical movement of the rack 34 in the extending direction of the upright 11, the vertical movement of the rack 34 can be guided in the extending direction of the upright 11 by the guide roller mechanisms 50 and 55. Accordingly, the rack 34 can be properly meshed with the pinion 35 coupled with the encoder 45 provided to the upright 11. Therefore, the position of the slide can be properly sensed by the encoder 45.

Further, in the slide position sensor 30 and the press machine 1, when the position of the slide 14 moved down by the crown 12 is sensed by the slide position sensor 30 to have arrived at a predetermined "brink position", the slide position sensor 30 teaches the arrival to the external controller by transmitting sensing signals to the external controller. Here, the "brink position" is a position of the slide 14 where the upper die 16 is at the brink of colliding with the workpiece W.

Subsequently, the external controller that has received the sensing signals controls the lifter 24 to move down the die-cushion pad 23.

Consequently, at the brink of the collision of the upper die 16 to the work W, the blank holder 21 supported by the die-cushion pad 23 is also moved down as well as the workpiece W disposed on top of the blank holder 21. As a result, the workpiece W undergoes preliminary acceleration in a manner fleeing from the upper die 16 at the brink of collision with the upper die 16. Therefore, the relative velocity between the upper die 16 and the workpiece W is decreased to reduce the shock upon contact between the upper die 16 and the workpiece W. Note that, after the upper die 16 contacts the workpiece W, the workpiece W is drawn by the upper die 16 and the lower die 17 while the die-cushion pad 23 is moved down by the lifter 24 according to hydraulic pressure in the hydraulic chamber of the lifter 24.

Also in the press machine 1, since the slide position sensor 30 is provided to be one for each of the four uprights 11, inclination of the slide 14 is properly sensed by the slide position sensors 30. Therefore, the downward movement of the slide 14 relative to the workpiece W can be properly controlled.

It should be noted that the slide position sensor and the press machine according to the present invention is not limited to the above embodiments, but an arrangement thereof can be suitably selected or changed as far as an inventive concept of the present invention is held.

For example, whereas the lifter 24 of the die-cushion device 20 according to the above embodiment includes the cushion cylinder mechanism that resiliently supports the die-cushion pad 23 integrally together with the lifting drive mechanism that lifts up and down the die-cushion pad 23, the mechanisms may be separately arranged and functioned.

What is claimed is:

1. A slide position sensor for sensing a relative position of a slide relative to one of a plurality of uprights, the slide being supported by a crown and lifted up and down, the crown being supported by the plurality of uprights the slide position sensor comprising:

a link supporting member projecting from the slide toward the one of the plurality of the uprights;

a dual axis link member whose first end is rotatably supported and hung by the link supporting member;

a plate rotatably supported and hung by a second end of the dual axis link member;

a rack that is provided to the plate and extends in a hanging direction;

a pinion that meshes with the rack; and an encoder that is fixed to the one of the plurality of uprights and senses a rotation of the pinion.

2. The slide position sensor according to claim 1, wherein a first allowance clearance is provided between the dual axis link member and the link supporting member, and a second allowance clearance is provided between the dual axis link member and the plate.

3. The slide position sensor according to claim 1, wherein a guide roller mechanism is fixed to the one of the plurality of uprights, and a vertical movement of the rack is guided in an extending direction of the one of the plurality of the uprights by the guide roller mechanism.

4. A press machine that draws a workpiece by an upper die and a lower die, comprising:

a plurality of uprights, a slide supported by a crown and lifted up and down, and a slide position sensor for sensing a relative position of the slide relative to one of the plurality of uprights, wherein the slide position sensor comprises a link supporting member projecting from the slide toward the one of the plurality of the uprights, a dual axis link member whose first end is rotatably supported and hung by the link supporting member, a plate rotatably supported and hung by a second end of the dual axis link member, a rack that is provided to the plate and extends in a hanging direction, a pinion that meshes with the rack, and an encoder that is fixed to the one of the plurality of uprights and senses a rotation of the pinion.

5. The press machine according to claim 4, wherein each of the plurality of the uprights is equipped with the slide position sensor.

* * * * *